US006302052B1

(12) United States Patent
Sauerwein

(10) Patent No.: US 6,302,052 B1
(45) Date of Patent: Oct. 16, 2001

(54) HORIZONTAL SHOTGUN AND/OR RIFLE RACK ASSEMBLY FOR HUNTING BOATS

(76) Inventor: Randy J. Sauerwein, 844 5th Ave. West, Kalispell, MT (US) 59901

( * ) Notice: Subject to any disclaimer, the term of this patent is extended or adjusted under 35 U.S.C. 154(b) by 0 days.

(21) Appl. No.: 09/624,722

(22) Filed: Jul. 25, 2000

(51) Int. Cl.[7] ..... B63B 35/00
(52) U.S. Cl. ..... 114/351; 114/343; 224/406
(58) Field of Search ..... 114/351; 224/42.45 R, 224/42.39, 42.33, 406, 42.11, 282; 211/64, 87

(56) References Cited

U.S. PATENT DOCUMENTS

| | | | |
|---|---|---|---|
| D. 272,785 | 2/1984 | Rumbaugh . | |
| D. 365,717 | 1/1996 | Cardenas . | |
| 3,876,078 | 4/1975 | Gomes et al. . | |
| 3,952,878 | 4/1976 | Gorham . | |
| 4,089,423 | 5/1978 | Gorham et al. . | |
| 4,144,971 | 3/1979 | Balibrea . | |
| 4,159,588 | 7/1979 | Pfeiffer . | |
| 4,450,989 | 5/1984 | Bogar, Jr. . | |
| 4,582,203 | 4/1986 | Davis . | |
| 5,078,279 | 1/1992 | Hancock et al. . | |
| 5,676,257 | 10/1997 | Adkins . | |
| 6,129,252 * | 10/2000 | Jackson et al. | 224/406 |

FOREIGN PATENT DOCUMENTS 2170994A 8/1986 (GB) .

* cited by examiner

*Primary Examiner*—Jesus D. Sotelo

(57) ABSTRACT

A horizontal shotgun and/or rifle rack assembly for hunting boats includes first and second racks to be mounted forward and aft of each other on a side of a boat. The first and second racks each have upper and lower, upwardly opening, U-shaped gun cradles for receiving, supporting and removably retaining barrels and/or butt stocks of two shotguns and/or rifles and supporting the two shotguns and/or rifles horizontally one above the other. Preferably, the gun cradles each have mechanisms for closing the upper opening in the cradle to prevent a gun from falling out of the racks should a boat overturn. The racks each have mounts for removably securing the racks to a gunwale of and within a boat with the upper gun cradles of the racks spaced below the gunwale so that a shotgun or rifle retained in the upper gun cradles of the racks is supported within the boat generally below the gunwale and with the lower gun cradles spaced above a bottom of the boat so that a shotgun or rifle retained in the lower gun cradles of the racks is supported above the bottom of the boat.

12 Claims, 3 Drawing Sheets

FIG. 1
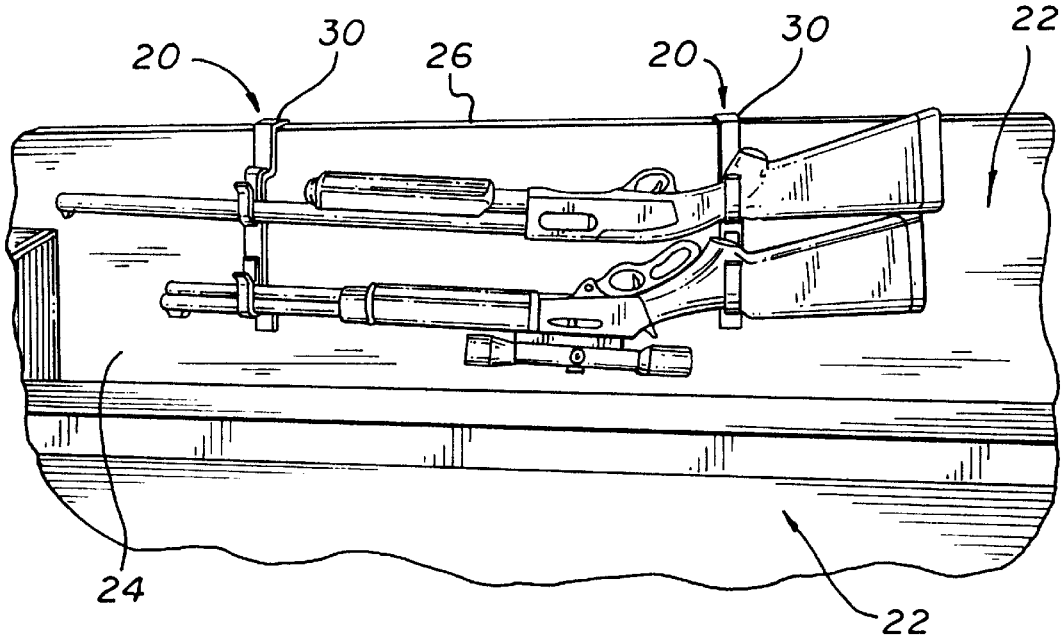
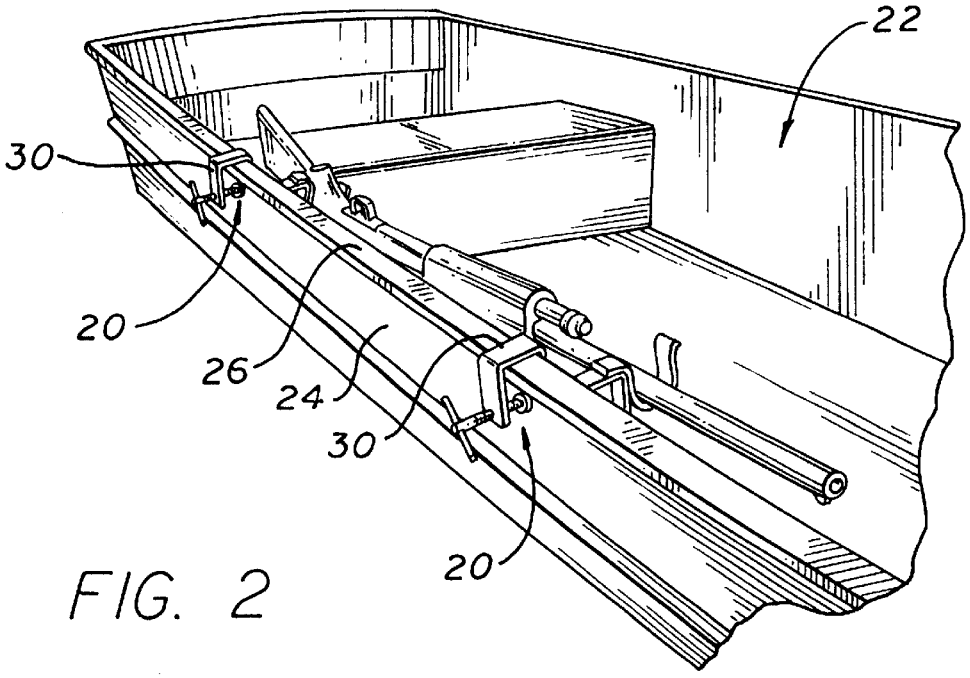
FIG. 2

FIG. 4
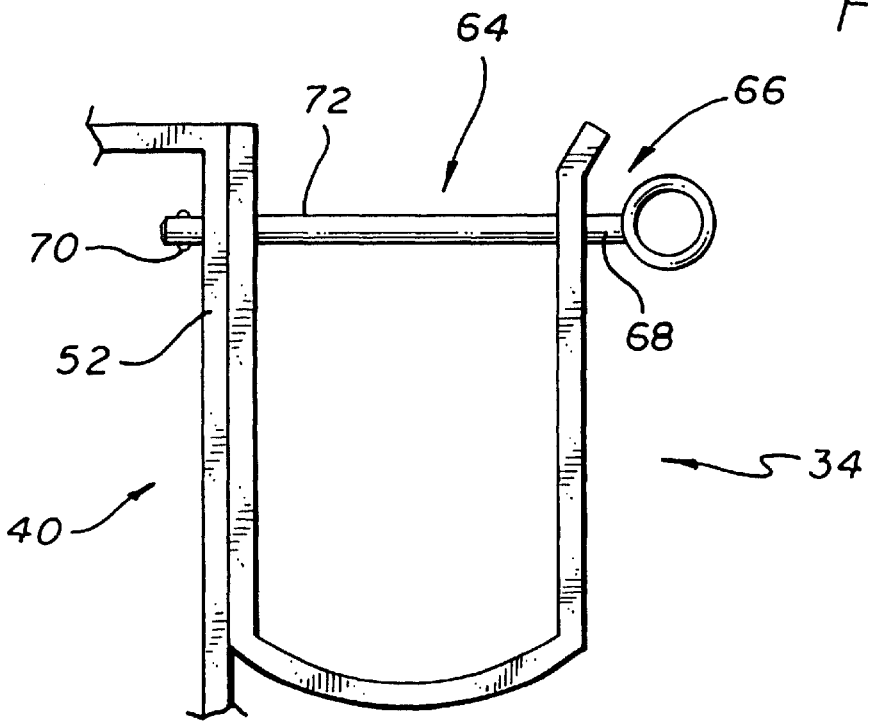
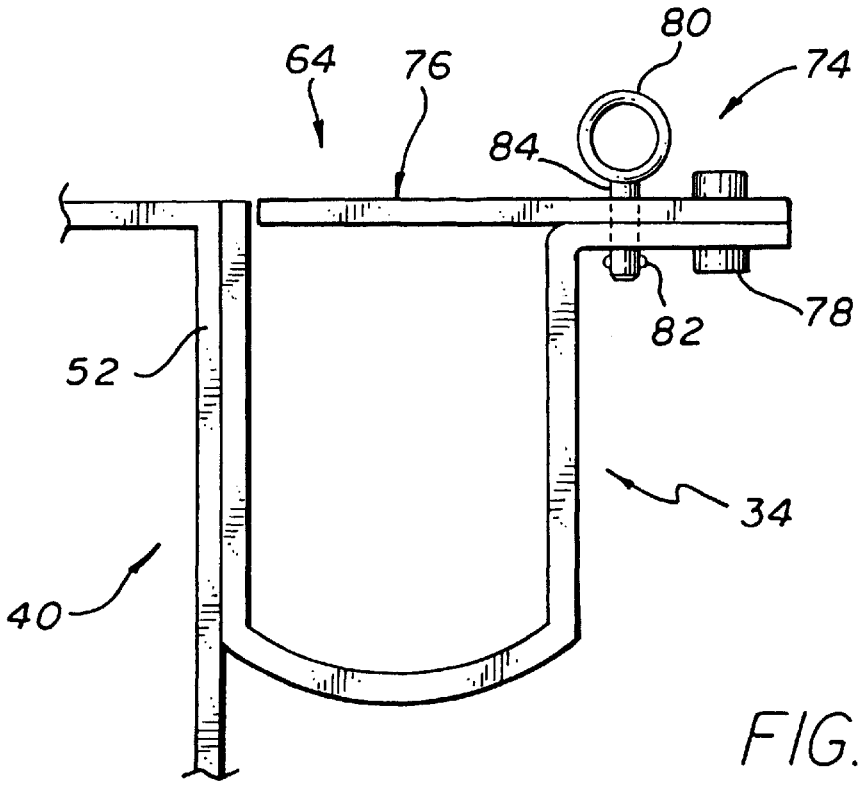
FIG. 5

HORIZONTAL SHOTGUN AND/OR RIFLE RACK ASSEMBLY FOR HUNTING BOATS

BACKGROUND OF THE INVENTION

The present invention relates to a horizontal shotgun and/or rifle rack assembly and, in particular, to a horizontal shotgun and/or rifle rack for use in hunting boats which: (a) can hold two shotguns, two rifles, or a shotgun and rifle in horizontal positions adjacent the side of a boat and generally below the gunwale (gunnel) of a boat where the shotgun(s) and/or rifle(s), although out of the way of the hunters in the boat to prevent the accidental discharge of or accidental damage to the shotgun(s) and/or rifle(s) by the hunters, are readily accessible to the hunters; (b) supports the shotgun(s) and/or rifle(s) above the bottom of the boat so that the shotgun(s) and/or rifle(s) do not get wet from water in the bottom of the boat; and (c) keeps the shotgun(s) and/or rifle(s) from getting lost if the hunting boat capsizes.

Hunting for water fowl, such as but not limited to duck hunting, is frequently carried out from within a hunting boat. While hunting boats may have other configurations, typically, hunting boats are flat bottomed boats with shallow, curved, side walls about thirteen inches in height. Over the years, there has been a need: for carrying shotguns and/or rifles in such boats in a way that reduces the chance of an accidental discharge of a shotgun or rifle; for keeping the shotgun(s) and/or rifle(s) out of the way when not in use to prevent damage to the shotgun(s) and/or rifle(s); for keeping the shotguns or rifles from getting wet if there is water in the bottom of the boat; for providing a shotgun or rifle rack assembly that does not interfere with the hunter when a shotgun or rifle has been removed from the rack and is in use; and for securing the shotgun(s) and/or rifle(s) to the boat so that the shotgun(s) and/or rifle(s) are not lost if the boat overturns, capsizes or is bumped into while traveling across the water.

U.S. Pat. No. 3,876,078, issued Apr. 8, 1975, and entitled "Portable Gun Rack" discloses a portable gun rack for mounting a gun in duck blinds, deer stands and the like. While suitable for mounting guns in duck blinds, deer stands and the like, the portable gun rack of the '078 patent is not suitable for mounting a gun in a shallow hunting boat. With the portable gun rack of the '078 patent receiving the butt end of the stock and the forward end portion of the gun stock to hold the gun in the rack, as shown in FIG. 1, and with the clamp for securing the rack to a duck blind or deer stand located at the upper end of the gun rack, the height of the portable gun rack of the '078 would be to great for mounting shotgun or rifle within a shallow hunting boat. U.S. Pat. No. 3,952,878, issued Apr. 27, 1976, entitled "Gun Stand" discloses a portable gun stand to be mounted in the ground which engages the rifle at the butt end of the stock and near the forward end of the barrel. U.S. Pat. No. 4,089,423, issued May 16, 1978, and entitled "Rifle Stand" discloses a gun stand to be mounted in the ground which engages the butt end of the stock and a midportion of the stock. U.S. Pat. No. 4,144,971, issued Mar. 20, 1979, and entitled "Gun Caddy" discloses a gun stand to be mounted in the ground which engages the butt end of the stock and the barrel of the shotgun. U.S. Pat. No. 4,159,588, issued Jul. 3, 1979, and entitled "Apparatus for Supporting Sporting Guns During Testing Intervals" discloses a frame for supporting a gun in a downward inclined position and for cooling the gun barrel. U.S. Pat. No. 4,450,989, issued May 29, 1984, and entitled "Gun Rack for Motor Vehicles" discloses a gun rack for supporting guns horizontally with elastic retaining means and end plates for mounting the gun rack on the back window of a vehicle such as a pickup truck. U.S. Pat. No. 4,582,203, issued Apr. 15, 1986, and entitled "Fishing Rod Holder", discloses two brackets for mounting a series of fishing rods along side each other. U.S. Pat. No. 5,078,279, issued Jan. 7, 1992, and entitled "Gun Rack" discloses a gun rack with an elastic hold down member which is permanently attached through its base unit 11 by means of screws or bolts to vertical surfaces which holds a gun in a horizontal position. U.S. Pat. No. 5,676,257, issued Oct. 14, 1997, and entitled "Gun Rack", discloses a gun rack with a locking mechanism for mounting by bolts through apertures 24 and 26 to a wall. U.K. patent application no. 2170994 A, published Aug. 20, 1986, and entitled "Gun Security Systems", discloses a lockable gun rack, to be permanently attached to a vertical surface, which engages the gun at the butt end of the stock, at a midportion of the stock rearward of the trigger guard, and at the forward end of the barrel. U.S Des. Pat. No. 272,785, issued Feb. 28, 1984, and entitled "Set of Brackets for Mounting on a Wall for Supporting Horizontally Oriented Fishing Rods", discloses two brackets to be mounted on a wall with a fastener that has cradles open at one side for supporting fishing rods. U.S. Des. Pat. No. 365,717, issued Jan. 2, 1996, and entitled "Portable Gun Rack", discloses a wire gun rack.

SUMMARY OF THE INVENTION

The horizontal shotgun and/or rifle rack assembly of the present invention provides an economical, efficient, safe, and easy to use solution to the problems associated with transporting and using shotgun(s) and/or rifle(s) in hunting boats, especially flat bottomed hunting boats with low sidewalls. The gun rack assembly of the present invention holds two shotguns and/or rifles in substantially horizontal positions within and adjacent a side of a boat so that the guns are out of the way of the hunters in the boat, protected by their location from potential damage, and secured to the boat when not in use to keep the guns from being lost should the boat overturn.

The gun rack assembly includes first and second racks to be mounted forward and aft of each other on a side of a boat to receive, support and removably retain barrels and butt stocks of two shotguns and/or rifles. The first and second racks each having upper and lower, upwardly opening, U-shaped gun cradles for receiving, supporting and removably retaining barrels and/or butt stocks of two shotguns and/or rifles and supporting two shotguns and/or rifles horizontally one above the other. The upper and lower gun cradles on each of the racks each have side portions extending upward from an intermediate bottom portion and an upper opening and the lower gun cradle on each rack is spaced below the upper gun cradle on each rack a distance sufficient to permit a shotgun or rifle to be easily placed in and removed from the lower gun cradles. Preferably, each of the gun cradles has a mechanism for closing the opening of the gun cradle and keeping a shotgun and/or rifle supported by the gun cradle from falling out of the gun cradle in the event a boat on which the gun rack assembly is mounted overturns.

The first and second racks each have mounting brackets for removably securing the first and second racks, e.g. by clamps, to a gunwale of and within a boat with the upper gun cradles of the racks spaced below the gunwale so that a shotgun or rifle retained in the upper gun cradles of the racks is supported within the boat generally below the gunwale and out of the way of the hunters within the boat and with the lower gun cradles spaced above a bottom of the boat so that a shotgun or rifle retained in the lower gun cradles of the racks is supported above the bottom of the boat to keep the gun from getting wet. The mounting brackets for removably securing the first and second racks to a gunwale of and within a boat space the upper and lower gun cradles inward from a side of a boat a distance sufficient to keep shotguns and/or rifles retained in the upper and lower gun cradles from contacting the curved side of a boat.

BRIEF DESCRIPTION OF THE DRAWINGS

FIG. 1 is an interior view of boat sidewall with a horizontal shotgun and/or rifle rack assembly of the present invention mounted on the sidewall.

FIG. 2 is a partial perspective view of the boat of FIG. 1 showing clamps releasably securing a shotgun and/or rifle rack assembly of the present invention to the gunwale of the boat.

FIG. 4 is a vertical end view of a gun cradle with a pin type retaining mechanism.

FIG. 5 is a vertical end view of a gun cradle with a pivot arm type retaining mechanism.

DESCRIPTION OF THE PREFERRED EMBODIMENTS

Figure 3:
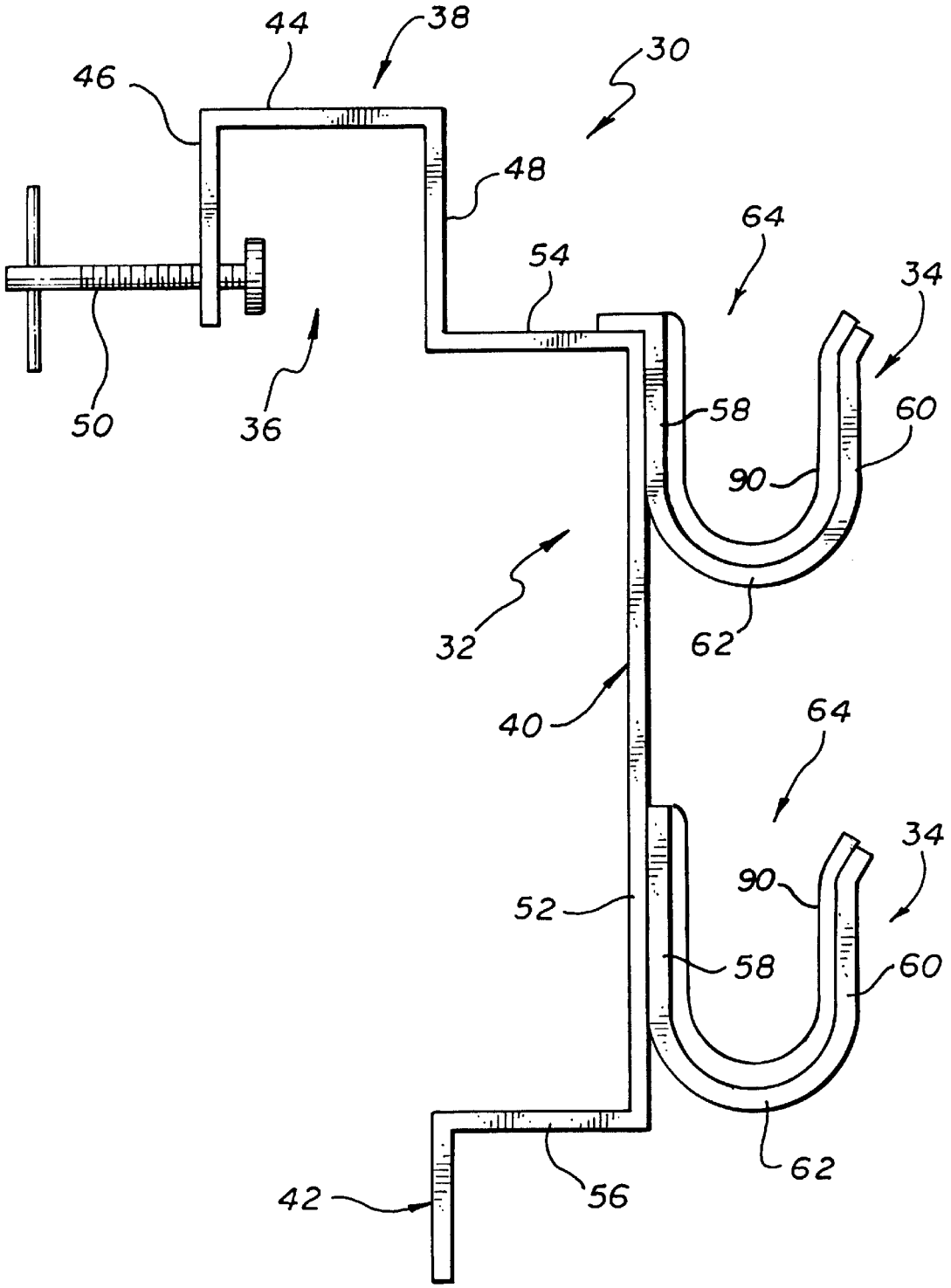
FIG. 3 is a vertical end view of one of the two racks of a horizontal shotgun and/or rifle assembly of the present invention.

As shown in FIGS. 1 and 2, the horizontal shotgun and/or rifle rack assembly 20 of the present invention is releasably secured to the gunwale of a hunting boat 22, such as but not limited to a flat bottomed hunting boat with low curved sidewalls, for safely transporting and providing easy access to shotgun(s) and/or rifle(s) by the hunters in the hunting boat. The gun rack assembly 20 of the present invention holds two shotguns and/or rifles in substantially horizontal positions within and adjacent a sidewall 24 of the boat 22 so that the guns: are out of the way of the hunters in the boat 22; protected by their location from potential damage; and, preferably, secured to the boat 22 when not in use to keep the guns from being lost should the boat overturn or capsize. The shotguns and/or rifles can be supported in the gun rack assembly 20 with the guns both facing forward or aft or with the guns facing in opposite directions.

As shown in FIGS. 1 and 2, the gun rack assembly 20 includes first and second racks 30 mounted forward and aft of each other on the sidewall 24 of the boat 22 to receive, support and removably retain barrels and butt stocks of two shotguns and/or rifles. As shown in FIG. 3, the first and second racks 30 each include a mounting bracket 32; upper and lower, upwardly opening, U-shaped gun cradles 34 for receiving, supporting and removably retaining barrels and/or butt stocks of two shotguns and/or rifles and supporting two shotguns and/or rifles horizontally one above the other; and a clamp 36 or equivalent mechanism for releasably securing the rack 30 to the gunwale 26 of the boat 22.

The mounting bracket 32 of each rack 30 includes: a downwardly opening channel shaped upper portion 38 for mounting on the gunwale 26; an intermediate channel shaped portion 40 which opens toward the sidewall 24 of the boat on which the rack 30 is mounted; and a lower extension 42 which extends downward from the intermediate portion 40. The downwardly opening channel shaped upper portion 38 includes an intermediate portion 44 which extends over the upper surface of the gunwale 26 and two flanges 46 and 48 extending downward from the intermediate portion. The outer flange 46 extends downward along the outer surface of the boat sidewall 24 and the inner flange 48 extends downward along the inner surface of the boat sidewall 24. Preferably, the outer flange 46 has a clevis screw 50 or similar screw mechanism threaded through a horizontally extending hole in the outer flange to form the clamp 36. By threading the clevis screw 50 inward after the downwardly opening channel shaped upper portion 38 is mounted over the gunwale 26, the rack 30 is easily secured to the gunwale 26 by clamping the gunwale between the clevis screw 50 and the inner flange 48. When the rack is removed for storage, etc., the rack 30 can be easily removed from the gunwale 26 by threading the clevis screw 50 outward and thereby unclamping the rack 30 from the gunwale 26. Typically, the intermediate portion 44 of the downwardly opening, channel shaped upper portion 38 of the mounting bracket is about 2⅛ inches wide and the flanges 46 and 48 of the downwardly opening, channel shaped upper portion 38 of the mounting bracket are about 2½ inches in height. The clevis screw 50 is typically mounted in the outer flange 46 about two inches from the top of the upper portion 38.

The intermediate channel shaped portion 40 of the mounting bracket 32 includes a generally vertically extending intermediate portion 52 and upper and lower flanges 54 and 56. The upper flange is integral with and extends inward from the lower end of the inner flange 48 of the upper portion 38 of the mounting bracket 32 and the lower flange is integral with and extends inward from the upper end of the lower extension 42 of the mounting bracket 32. The flanges 54 and 56 of the intermediate channel shaped portion 40, which opens toward the sidewall 24 of the boat on which the rack 30 is mounted, space the gun cradles 34 outward from the sidewall 24 of the boat 22 (typically, about 2¾ inches to 3¾ inches) so that the shotgun(s) and/or rifle(s) held in the gun cradles 34 do not come in contact with the sidewall 24 and are easily placed in or removed from the cradles 34. The sidewalls 24 of hunting boats a generally curved from bow to stern and without sufficient inward spacing of the gun cradles 34 from the sidewall 24 on which the racks 30 are mounted, the guns could be scraped against the inner surface of the sidewall 24. Preferably, the mounting bracket 38 is made from a flat metal strap, such as but not limited to a flat strap of steel, stainless steel, aluminum about 1¼ inches wide by ⅛ of an inch thick by 20⅜ inches long, but could also be made of a strong, durable polymeric material.

The upper and lower upwardly opening, U-shaped gun cradles 34 on each of the racks 30 each have side portions 58 and 60 extending upward from an intermediate bottom portion 62 and an upper opening 64. Typically, the side portions 58 of the gun cradles 34 are welded, riveted or otherwise permanently secured to the intermediate portion 40 of the mounting bracket 32. The lower gun cradle 34 on each rack 30 is spaced below the upper gun cradle 34 on each rack 30 a distance sufficient to permit a shotgun or rifle to be easily placed in and removed from the lower gun cradles 34 of the horizontal shotgun and/or rifle rack assembly 20. In addition, the upper gun cradles 34 of the racks 30 are spaced below the upper surface of the gunwale 26 so that a shotgun or rifle retained in the upper gun cradles 34 of the racks 30 of the horizontal shotgun and/or rifle rack assembly 20 is supported within the boat 22 generally below the upper surface of the gunwale 26 and out of the way of the hunters within the boat and the lower gun cradles 34 are spaced above a bottom of the boat 22 (typically, at least two inches and preferably three inches above the upper surface of the bottom of the boat) so that a shotgun or rifle retained in the lower gun cradles 34 of the racks 30 is supported above the bottom of the boat to keep the gun from getting wet. Typically, the gun cradles 34 are about 2½ to about 3½ inches deep and have a width sufficient to accommodate either the barrels and butt stocks of the shotguns or rifles supported in the gun rack assemblies. Typically, the bottoms 62 of the upper gun cradles 34 are about 5 inches below the upper surface of the gunwale 26 and the bottoms of the lower gun cradles 34 are about 10 inches below the upper surface of the gunwale 26. The gun cradles 34 are typically made from a flat metal strap, such as but not limited to a flat strap of steel, stainless steel or aluminum about ¾ inch wide by ⅛ inch thick by about 6 to about 7 inches long, but could also be made of a strong, durable polymeric material.

Preferably, the inner surfaces of the gun cradles 34, which will come into contact with the guns held by the horizontal shotgun and/or rifle rack assembly 20, are padded with or encased within a fabric, rubber, a conventional foam padding material or some other material to prevent the gun cradles from scratching the guns held in the horizontal shotgun and/or rifle assembly 20. By way of example, the padding may take the form of pads 90 adhered to the inner surfaces of the gun cradles 34 or after the mounting bracket 32 is formed and the gun cradles 34 are secured to the mounting bracket 32, the mounting bracket 32 and the gun cradles 34 can be coated with a rubber or other polymeric material by dipping or spraying or other conventional methods to form a protective covering over the mounting bracket 32 and the gun cradles 34 so that the bracket and gun cradles do not mar the boat sidewall or guns held in the horizontal shotgun and/or rifle rack assembly 20.

Preferably, as shown in FIGS. 4 and 5, each of the gun cradles 34 has a retaining mechanism for closing the opening 64 of the gun cradle and keeping a shotgun and/or rifle supported by the gun cradle 34 from falling out of the gun cradle 34 in the event a boat on which the gun rack assembly 20 is mounted overturns. In the embodiment of FIG. 4, the retaining mechanism 66 associated with each of the gun cradles 34 includes horizontally aligned holes in the side portions of each gun cradle 34, adjacent the opening 64 of each gun cradle, and the intermediate portion 40 of the mounting bracket 32 plus a pin 68, e.g. a metallic ball pin, which can be inserted through the aligned holes in the side portions of the gun cradle 34 and the intermediate portion 40 of the mounting bracket 32 to close the opening 64 in the gun cradle and removed from the aligned holes in the gun cradle 34 and mounting bracket 32 to open the opening 64 in the gun cradle 34. Outwardly, biased balls 70 of the ball pin 68, adjacent the end of the pin shaft 72 inserted into the aligned holes in the gun cradle 34 and the mounting bracket 32 releasably secure the pin 68 within the aligned holes of the gun cradle and mounting bracket. The balls 70 are pressed into the pin shaft 72 as the shaft is inserted into the aligned holes in the gun cradle and the mounting bracket and biased back outwardly once the end of pin shaft exits the aligned holes. Typically, the shaft 72 of the pin 68 would have a diameter of about ¼ inch and the aligned holes a diameter of about ⅜ inch.

In the embodiment of FIG. 5, the retaining mechanism 74 associated with each of the gun cradles 34 includes an arm 76 pivotally mounted on the gun cradle 34 by a suitable fastener 78, such as but not limited to a nut and bolt, which can be pivoted to a first position over the opening 64 of the gun cradle 34 to close the opening 64 of the gun cradle 34 and pivoted away from the opening 64 of the gun cradle 34 to a second position to open the opening 64 of the gun cradle 34. Preferably, a pin 80, such as but not limited to a ball pin, releasably secures the arm 76 in place in the first position. The ball pin 80 has outwardly, biased balls 82, adjacent the end of the pin shaft 84. When the shaft 84 is inserted into aligned holes in the arm 76 and the gun cradle 34, the outwardly biased balls 82 releasably secure the pin 80 within the aligned holes of the arm 76 and the gun cradle 34. The balls 82 are pressed into the pin shaft 84 as the shaft is inserted into the aligned holes in the arm 76 and gun cradle 34 and biased back outwardly once the end of pin shaft 84 exits the aligned holes. Typically, the shaft 84 of the pin 80 would have a diameter of about ¼ inch and the aligned holes a diameter of about ⅜ inch.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A horizontal shotgun and/or rifle rack assembly for hunting boats, comprising:

a gun rack assembly for holding two shotguns and/or rifles in substantially horizontal positions within and adjacent a side of a boat; the gun rack assembly including first and second racks to be removably mounted forward and aft of each other on a side of a boat to receive, support and removably retain barrels and butt stocks of two shotguns and/or rifles;

the first and second racks each having upper and lower, upwardly opening, U-shaped gun cradles for receiving, supporting and removably retaining barrels and/or butt stocks of two shotguns and/or rifles and supporting two shotguns and/or rifles horizontally one above the other; the upper and lower gun cradles on each of the racks each having side portions extending upward from an intermediate bottom portion and an upper opening; the lower gun cradle on each rack being spaced below the upper gun cradle on each rack a distance sufficient to permit a shotgun or rifle to be placed in and removed from the lower gun cradles; and the first and second racks each having mounting means for removably securing the first and second racks to a gunwale of and within a boat with the upper gun cradles of the racks spaced below the gunwale so that a shotgun or rifle retained in the upper gun cradles of the racks is supported within the boat generally below the gunwale and with the lower gun cradles spaced above a bottom of the boat so that a shotgun or rifle retained in the lower gun cradles of the racks is supported above the bottom of the boat; the mounting means for removably securing the first and second racks to a gunwale of and within a boat including means for spacing the upper and lower gun cradles inward from a side of a boat a distance sufficient to keep shotguns and/or rifles retained in the upper and lower gun cradles from contacting the side of a boat; and the mounting means for removably securing each of the racks on the gunwale of and within a boat includes a clamp for extending over a gunwale and removably clamping the rack to a side of a boat adjacent the gunwale.

2. The horizontal shotgun and/or rifle rack assembly for hunting boats according to claim 1, including:

a retaining means associated with each of the gun cradles for closing the opening of the gun cradle and keeping a shotgun and/or rifle supported by the gun cradle from falling out of the gun cradle in the event a boat on which the gun rack assembly is mounted overturns.

3. The horizontal shotgun and/or rifle rack assembly for hunting boats according to claim 2, wherein:

the retaining means associated with each of the gun cradles includes aligned holes in the side portions of the gun cradle adjacent the opening of the gun cradle; a pin which can be inserted through the aligned holes in the side portions of the gun cradle to close the opening in the gun cradle and removed from the aligned holes in the gun cradle to open the opening in the gun cradle, and means for releasably securing the pin within the aligned holes of the gun cradle.

4. The horizontal shotgun and/or rifle rack assembly for hunting boats according to claim 2, wherein:

the retaining means associated with each of the gun cradles includes an arm pivotally mounted on the gun cradle which can be pivoted to a first position over the opening of the gun cradle to close the opening of the gun cradle and pivoted away from the opening of the gun cradle to a second position to open the opening of the gun cradle and means for releasably securing the arm in place in the first position.

5. The horizontal shotgun and/or rifle rack assembly for hunting boats according to claim 1, wherein:

the mounting means for removably securing each of the racks on the gunwale of and within a boat locates the upper gun cradles of the racks with the bottom portions of the upper gun cradles from about five inches to about seven inches below a gunwale to which the racks are secured and the lower gun cradles of the racks with the bottom portions of the lower gun cradles from about ten inches to about twelve inches below a gunwale to which the racks are secured; and the mounting means locates the side portions of each of the gun cradles that are closest to a side of the boat to which the racks are secured from about two and three quarter inches to about three and three quarter inches from the side of the boat.

6. The horizontal shotgun and/or rifle rack assembly for hunting boats according to claim 1, wherein:

each of the gun cradles is padded.

7. A hunting boat with a horizontal shotgun and/or rifle rack assembly, comprising:

a boat; a gun rack assembly for holding two shotguns and/or rifles in substantially horizontal positions within and adjacent a side of the boat; the gun rack assembly including first and second racks removably mounted forward and aft of each other on the side of the boat to receive, support and removably retain barrels and butt stocks of two shotguns and/or rifles;

the first and second racks each having upper and lower, upwardly opening, U-shaped gun cradles for receiving, supporting and removably retaining barrels and/or butt stocks of two shotguns and/or rifles and supporting two shotguns and/or rifles horizontally one above the other; the upper and lower gun cradles on each of the racks each having side portions extending upward from an intermediate bottom portion and an upper opening; the lower gun cradle on each rack being spaced below the upper gun cradle on each rack a distance sufficient to permit a shotgun or rifle to be placed in and removed from the lower gun cradles; and the first and second racks each having mounting means removably securing the first and second racks to a gunwale of and within the boat with the upper gun cradles of the racks spaced below the gunwale so that a shotgun or rifle retained in the upper gun cradles of the racks is supported within the boat generally below the gunwale and with the lower gun cradles spaced above a bottom of the boat so that a shotgun or rifle retained in the lower gun cradles of the racks is supported above the bottom of the boat; the mounting means for removably securing the first and second racks to the gunwale of and within the boat including means for spacing the upper and lower gun cradles inward from the side of the boat a distance sufficient to keep shotguns and/or rifles retained in the upper and lower gun cradles from contacting the side of the boat; and the mounting means for removably securing each of the racks on the gunwale of and within the boat includes a clamp extending over the gunwale and removably clamping the rack to the side of the boat adjacent the gunwale.

8. The hunting boat with the horizontal shotgun and/or rifle rack assembly according to claim 7, including:

a retaining means associated with each of the gun cradles for closing the opening of the gun cradle and keeping a shotgun and/or rifle supported by the gun cradle from falling out of the gun cradle in the event the boat overturns.

9. The hunting boat with the horizontal shotgun and/or rifle rack assembly according to claim 8, wherein:

the retaining means associated with each of the gun cradles includes aligned holes in the side portions of the gun cradle adjacent the opening of the gun cradle; a pin which can be inserted through the aligned holes in the side portions of the gun cradle to close the opening in the gun cradle and removed from the aligned holes in the gun cradle to open the opening in the gun cradle, and means for releasably securing the pin within the aligned holes of the gun cradle.

10. The hunting boat with the horizontal shotgun and/or rifle rack assembly according to claim 8, wherein:

the retaining means associated with each of the gun cradles includes an arm pivotally mounted on the gun cradle which can be pivoted to a first position over the opening of the gun cradle to close the opening of the gun cradle and pivoted away from the opening of the gun cradle to a second position to open the opening of the gun cradle and means for releasably securing the arm in place in the first position.

11. The hunting boat with the horizontal shotgun and/or rifle rack assembly according to claim 7, wherein:

the mounting means for removably securing each of the racks on the gunwale of and within the boat locates the upper gun cradles of the racks with the bottom portions of the upper gun cradles from about five inches to about seven inches below the gunwale to which the racks are secured and the lower gun cradles of the racks with the bottom portions of the lower gun cradles from about ten inches to about twelve inches below the gunwale to which the racks are secured; and the mounting means locates the side portions of each of the gun cradles that are closest to the side of the boat to which the racks are secured from about two and three quarter inches to about three and three quarter inches from the side of the boat.

12. The hunting boat with the horizontal shotgun and/or rifle rack assembly according to claim 7, wherein:

each of the gun cradles is padded.

* * * * *